US005351345A

United States Patent [19]

Sills et al.

[11] Patent Number: 5,351,345

[45] Date of Patent: Oct. 4, 1994

[54] BATH TUB HAVING SIDE ACCESS

[75] Inventors: Arthur A. Sills, Traverse City; Frederick A. Kilbourn; Brian K. Nelson, both of Suttons Bay; Donald J. Henderson, Traverse City, all of Mich.

[73] Assignee: Siltech Products Incorporated, Traverse City, Mich.

[21] Appl. No.: 910,775

[22] Filed: Jul. 8, 1992

[51] Int. Cl.[5] ..... A47K 3/022

[52] U.S. Cl. ..... 4/555; 4/557; 4/558

[58] Field of Search ..... 4/555, 556, 558, 557, 4/607, 610; 49/477.1, 498.1, 200

[56] References Cited

U.S. PATENT DOCUMENTS

| | | | |
|---|---|---|---|
| D. 261,796 | 11/1981 | Queen . | |
| D. 270,658 | 9/1983 | Sills et al. . | |
| D. 273,700 | 5/1984 | Parker . | |
| 2,081,728 | 5/1937 | Bassett . | |
| 2,569,825 | 10/1951 | Otis . | |
| 2,570,053 | 10/1951 | Fowler et al. . | |
| 2,576,623 | 11/1951 | McLaughlin . | |
| 2,587,335 | 2/1952 | Landergott . | |
| 2,804,629 | 9/1957 | Ring . | |
| 2,914,775 | 12/1959 | Kauffman | 4/557 |
| 2,936,463 | 5/1960 | Tracy . | |
| 2,977,604 | 4/1961 | Miller . | |
| 3,066,316 | 12/1962 | Russell . | |
| 3,113,323 | 12/1963 | Beardsley . | |
| 3,366,978 | 2/1968 | Jones . | |
| 3,371,354 | 3/1968 | Hayslett . | |
| 3,380,078 | 4/1968 | Hanson . | |
| 3,416,166 | 12/1968 | Hanson . | |
| 3,423,769 | 1/1969 | Cowley . | |
| 3,562,821 | 2/1971 | Queen . | |
| 3,604,018 | 9/1971 | Moran . | |
| 3,662,409 | 5/1972 | Johansson . | |
| 3,663,971 | 5/1972 | Bonhote . | |
| 3,703,733 | 11/1972 | McLoughlin . | |
| 3,719,960 | 3/1973 | Russell . | |

(List continued on next page.)

FOREIGN PATENT DOCUMENTS

| | | |
|---|---|---|
| 921653 | 2/1973 | Canada . |
| 1054752 | 5/1979 | Canada . |
| 1214603 | 4/1984 | Canada . |
| 1214604 | 4/1984 | Canada . |
| 1177603 | 11/1984 | Canada . |
| 1254703 | 5/1989 | Canada . |
| 2434617 | 8/1978 | France . |

(List continued on next page.)

OTHER PUBLICATIONS

European Search Report dated Dec. 2, 1993, and including Patent family list.

*Primary Examiner*—Henry J. Recla
*Assistant Examiner*—Charles R. Eloshway
*Attorney, Agent, or Firm*—Learman & McCulloch

[57] ABSTRACT

The bath tub (10) having side access has a main tub body (12), a door support, a tambour door assembly (16), a door seal 18 and a control system (20). The door support includes door guide assemblies (64). A tambour door (66) with a plurality of tambour slats (76 or 401) and a flexible impervious membrane (86) is guided by the door guide assemblies (64). The tambour door (66) is in a horizontal position under the floor (27) when it is open and in a vertical position closing the open side (28) of the main tub body (12) when it is closed. A seal (18) seals between the main tub body and the membrane (86). The seal (18) includes a tube (155) that is inflated to seal between the main tub (12) and the tambour door (66). The control system (20) closes the drain 46 when the tambour door (66) is closed and the seal (18) is inflated and the tambour door (66) is constrained in the closed position. The tambour door is constrained in the closed position until the control system 48 senses that the water level in the tub has dropped below a predetermined level and the seal (18) is deflated. A valance (114) limits movement of the tambour door (66) away from the seal (18)

61 Claims, 11 Drawing Sheets

U.S. PATENT DOCUMENTS

| | | | |
|---|---|---|---|
| 3,736,924 | 6/1973 | Jacuzzi et al. . | |
| 3,863,275 | 2/1975 | Brendgord et al. . | |
| 3,924,278 | 12/1975 | Ekman . | |
| 4,099,272 | 7/1978 | Sowder . | |
| 4,112,524 | 9/1978 | Johansson . | |
| 4,118,810 | 10/1978 | Brickhouse et al. . | |
| 4,171,545 | 10/1979 | Kann . | |
| 4,339,569 | 8/1983 | Houle . | |
| 4,346,485 | 8/1982 | Reed et al. . | |
| 4,365,367 | 12/1982 | Houle et al. . | |
| 4,439,877 | 4/1984 | Houle . | |
| 4,446,586 | 5/1984 | Reed et al. . | |
| 4,523,341 | 6/1985 | Queen . | |
| 4,546,506 | 10/1985 | Houle et al. . | |
| 4,583,251 | 4/1986 | Furst et al. . | |
| 4,592,099 | 6/1986 | Zellner . | |
| 4,607,658 | 8/1986 | Fraser et al. | 4/508 |
| 4,656,714 | 4/1987 | Evans et al. | 49/477.1 |
| 4,796,312 | 1/1989 | Corlew | 4/555 |
| 4,993,087 | 2/1991 | Roguebrune | 4/555 |
| 5,163,187 | 11/1992 | Dannenberg et al. | 4/555 |
| 5,184,358 | 2/1993 | Gruidel et al. | 4/555 |

FOREIGN PATENT DOCUMENTS

| | | | |
|---|---|---|---|
| 89071838 | 4/1970 | Monaco . | |
| 1226206 | 3/1971 | United Kingdom | 4/555 |
| 1287756 | 9/1972 | United Kingdom | 49/200 |
| 8603389 | 6/1986 | World Int. Prop. O. | 4/555 |

BATH TUB HAVING SIDE ACCESS

TECHNICAL FIELD

The invention relates to bath tubs, and more particularly to bath tubs with side access to facilitate ingress and egress.

Side access is advantageous for physically challenged individuals and others who desire to avoid climbing over the side of a tub, to reduce the possibility of a fall while entering or exiting the tub and to facilitate lateral transfers into or out of the tub.

BACKGROUND OF THE INVENTION

Bath tubs with side doors that can be lifted up to a storage position above the main tub section are commercially available. These bath tubs function well and are found in many hospitals and nursing homes. The overhead door storage requires overhead storage space, a track system to guide and support the door, and a lift system to lift the door to the storage position. These bath tubs require more space than is available in most home bathrooms. They are also too large to be moved into existing home bathrooms even if the bathroom is large enough to house the tub and door assembly. The track system and the door lift systems add substantial complexity and cost to the bath tub units.

Bath tubs with side doors that are hinged to a main tub section have been known for many years. Hinged doors often provide limited access to a tub, require an elaborate latching system and, in at least some cases, leak. The force exerted against a bath tub side door depends upon the depth of the water and the surface area of the door in contact with the water. Hinged bath tub doors generally have a reduced area to limit the total force applied against the doors. It is also common for the doors to have a bottom edge that is above the bottom wall to further reduce the total force applied against the door. Reduced door size impedes bath tub ingress and egress and renders such bath tubs unusable by some individuals. A space for a hinged door to swing outwardly away from the main portion of a tub during opening and closing must be provided. The door must have room to move into a position in which it does not block movement of a bather who is moving to or from the tub. Hinged doors compress door seals, slide along the surface of portions of seals, and may rotate on the surface of a portion of a door seal. Sliding contact with untreated seals causes seal wear and may lead to leaks.

Bath tubs with side doors that slide up and down have been proposed. Such doors may be difficult to open and close and require special sealing systems to prevent leaks. Operation of levers and cams that are part of the sealing system may require substantial dexterity.

SUMMARY OF THE INVENTION

An object of the invention is to provide a bath tub having side access with a full-width tambour door for opening and closing the access opening.

Another object of the invention is to provide a bath tub with a full-width tambour door for side access that is positioned under the tub floor when it is open.

A further object of the invention is to provide a bath tub with a full-width door for side access with an inflatable seal in combination with a lip seal.

A still further object of the invention is to provide a retainer system that limits movement of the tambour door away from the main tub section and locks the door to the tub when the tambour door is closed.

Yet another object of the invention is to provide a bath tub having side access with a tambour door assembly mounted on a support frame that can be moved away from the main tub section for cleaning and maintenance.

A yet further object of the invention is to provide a bath tub having side access and an access door with a control system that closes the drain by inflating an inflatable drain bellows after the door is locked in a closed position and the seal is inflated and that will allow the door to be opened when the water is drained and the tub seal is deflated.

The bath tub has a main tub body with a fixed side wall, two fixed end walls, a bottom wall, and an open side. If desired, a seat for supporting a bather in a sitting position can be an integral part of the tub. A tambour door and a track assembly are connected to the main tub body. The tambour door includes a plurality of tambour slats and a flexible impervious membrane attached to the tambour slats. The track assembly guides the tambour door between a horizontal position under the tub floor and a generally vertical position adjacent to the open side and in which the tambour door closes the open side.

A tub seal is provided between the main tub body and the tambour door to prevent water leaks. The tub seal includes a tubular cavity that can be inflated to seal tightly. The tub seal also includes a lip seal that is actuated by water pressure.

The tambour door and track assembly are connected to the main tub body by a support frame. The support frame is slideably attached to the main tub body by slide mechanisms. A valance is a part of the support frame and can limit lateral movement of the tambour door away from the main tub body. Interfitting lock members can also be provided to limit lateral movement of the tambour door if desired.

The support frame with the tambour door, a track assembly, and a valance can also be pivotally attached to the main tub body rather than being attached by slide mechanisms. When the support frame is pivotally attached rather than slideably attached to the main tub body, the tambour door must not be in the fully open horizontal position under the tub floor. When the tambour door is in a vertical closed position, the upper part of the support frame can pivot away from the main tub body and the portions of the support frame that support the horizontal track for the tambour door can pivot upwardly inside cavities formed in each end wall of the main tub body.

A control system is provided for closing the drain, locking the tambour door in a closed position, pressurizing the door seal, and indicating that the tub is ready to be filled. The control system can be activated to open the tub drain, and after the water level in the tub has dropped sufficiently, to allow compressed fluid to escape from the tub seal and unlock the tambour door.

Further objects, features, and other aspects of this invention will be understood from the following detailed description of a preferred embodiment thereof as illustrated in the accompanying drawings.

THE DRAWINGS

FIG. 1 is a perspective view of the bath tub with the tambour door open;

FIG. 2 is a perspective view of the bath tub with the tambour door closed;

FIG. 3 is a perspective view of the bath tub with the support frame for the tambour door moved horizontally away from the main tub body on slide mechanisms and the tambour door removed to show the support frame;

FIG. 4 is an enlarged, fragmentary, sectional view of a lower portion of the valance taken along line 4—4 in FIG. 3;

FIG. 5 is an enlarged sectional view of one of the slide mechanisms taken along line 5—5 in FIG. 3;

FIG. 6 is an enlarged, fragmentary sectional view of the bath tub with the tambour door in the closed position taken along line 6—6 in FIG. 2;

FIG. 7 is an enlarged end view of the tambour slat at 7 in FIG. 6;

FIG. 8 is a fragmentary sectional view of a tambour slat taken along line 8—8 in FIG. 7;

FIG. 9 is an enlarged, fragmentary sectional view of the tub seal and the tambour door membrane taken along line 9—9 in FIG. 3;

FIG. 10 is an enlarged, fragmentary sectional view of one end of a tambour slat and the support frame taken along line 10—10 in FIG. 6;

FIG. 11 is an enlarged, fragmentary side elevational view of one of the L-shaped support frame members, the take-up spring system, and the drip pan;

FIG. 12 is a fragmentary sectional view of an L-shaped support frame member taken along the line 12—12 in FIG. 11;

FIG. 13 is a fragmentary view of one end of the main tub section with the valance removed showing an alternate system for locking the tambour door to the main tub section when the tambour door is closed;

FIG. 14 is an enlarged vertical view of two of the retainer tabs for locking the tambour door to the main tub section;

FIG. 15 is an enlarged, fragmentary, sectional view of one of the tambour slats and a portion of the membrane attached to the tambour slat;

FIG. 16 is a diagrammatic view of the control system for the bath tub;

FIG. 17 is a fragmentary sectional view of the bath tub with the support frame and the valance for the tambour door pivotally attached to the main tub section taken along line 17—17 in FIG. 2;

FIG. 18 is a fragmentary sectional view of the bath tub with the pivotally attached support frame and valance partially opened taken along line 18—18 in FIG. 17; and FIG. 19 is an enlarged, fragmentary sectional view similar to FIG. 9 showing a one piece seal that can be used in place of the two piece seal.

DESCRIPTION OF THE DRAWINGS

The bath tub 10 having side access includes a main tub body 12, a door support frame 14, a tambour door assembly 16, a door seal 18, and a control system 20. The main tub body 12 is an integral rigid section with a side wall 22, a first end wall 24 attached to one end of the side wall 22, a second end wall 26 attached to the other end of the side wall 22, a floor 27, and an open side 28. The main tub section 12 is made from fiberglass reinforced plastic or some other durable rigid non-corrosive material. The side wall 22 is filled with a rigid structural foam to increase rigidity. The end walls 24 and 26 are partially filled with the same foam for increased rigidity, but have cavities 30 for the door support frame 14 for the tambour door assembly.

A molded fiberglass seat 32 can be formed in one end of the main tub body 12 if desired or the main tub body can be open to allow a bather to lay down in the tub. If a seat 32 is provided, it has a back 34, a seat 36, an optional trough 38 in the center of the seat for water drainage, and a kick wall 40. An optional trough 39 between the side wall 22 and the seat 32, and between the end wall 26 and the seat, as shown in FIG. 3, can be provided for water drainage if desired in addition to or in place of the trough 38. The back 34, the seat 36, and the kick wall 40 are an integral part of the main tub body 12 and form a portion of the side wall 22, the end wall 26, and the floor 27. The floor 27 has a raised side section 44 and a drain 46. The raised side section 44 directs water from the open side 28 toward the drain and allows the tambour door assembly 16 to be opened while the water is still draining from the surface of the tub 10. The raised side section 44 is above the floor 27 a few inches and a bather's feet have to be raised up over the raised side section to enter and exit the bath tub 10. The raised side section 44 is preferably raised less if the main tub body 12 is open to allow a bather to lay down. However, the raised side section 44 is raised some and the entire floor 27 slopes toward the drain 46.

Figure 1:
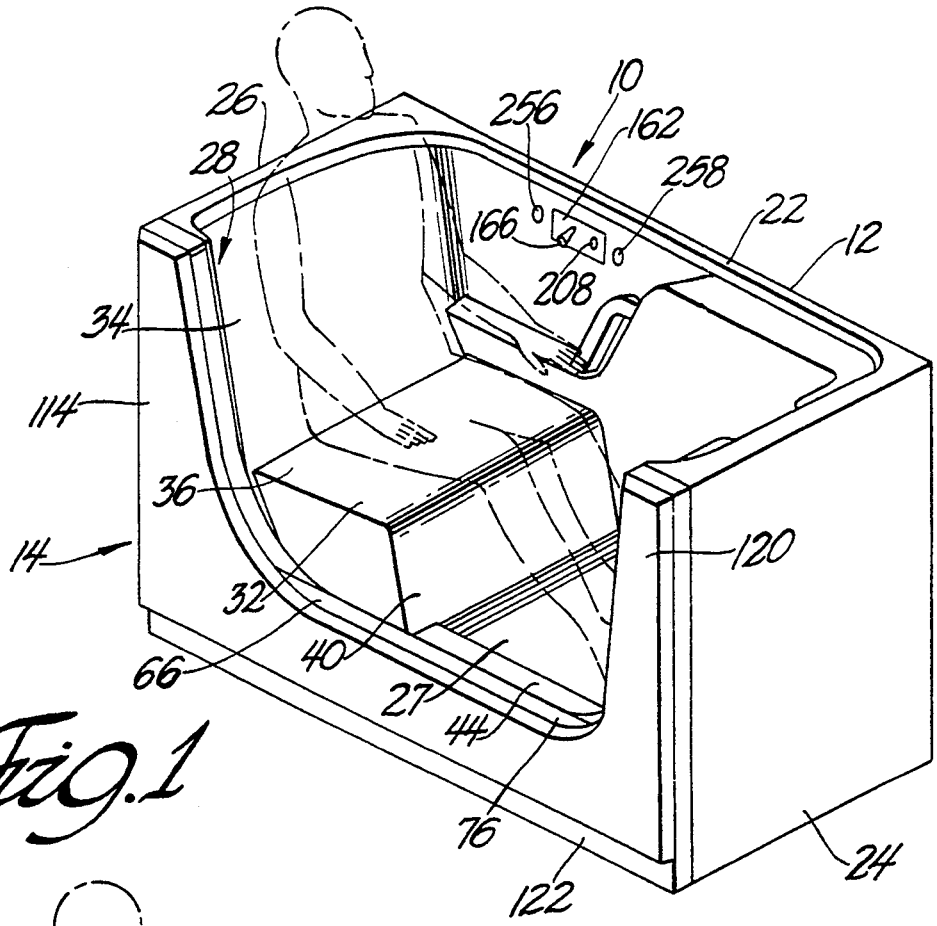
Figure 2:
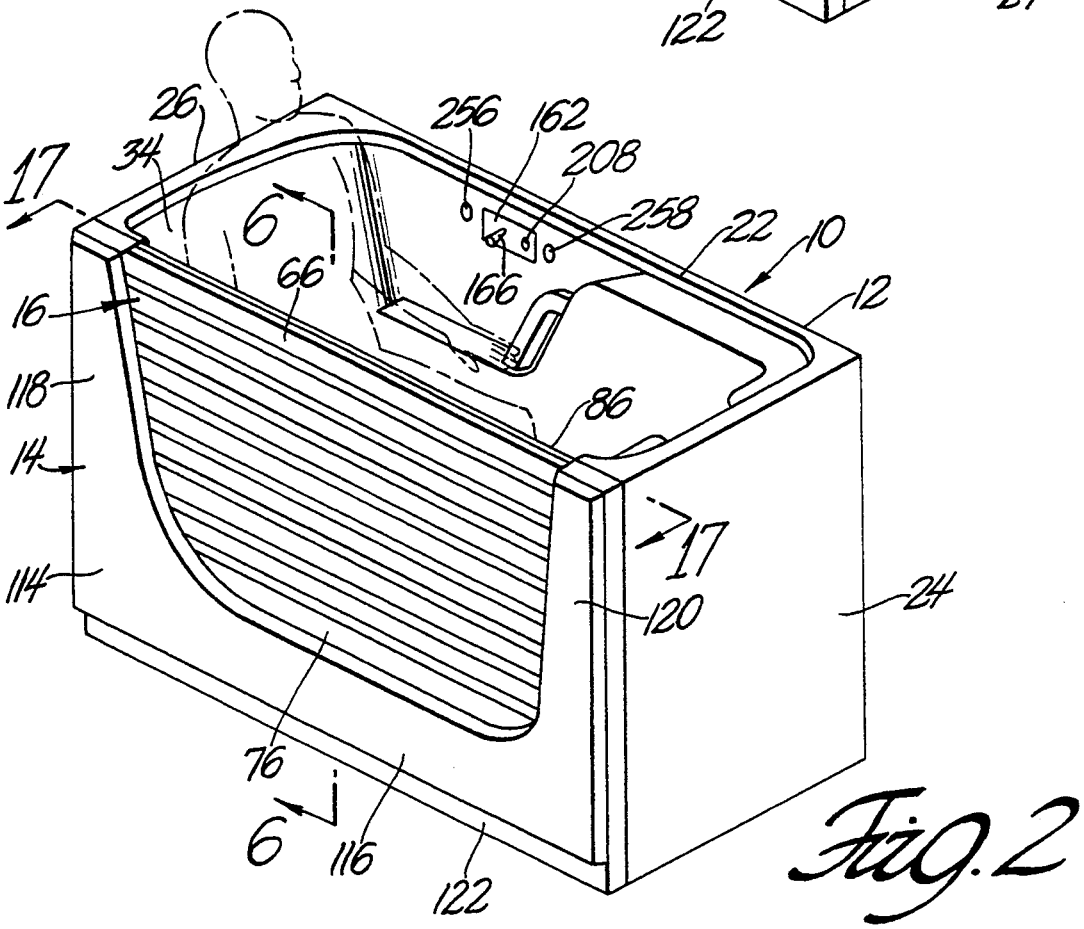
Figure 3:
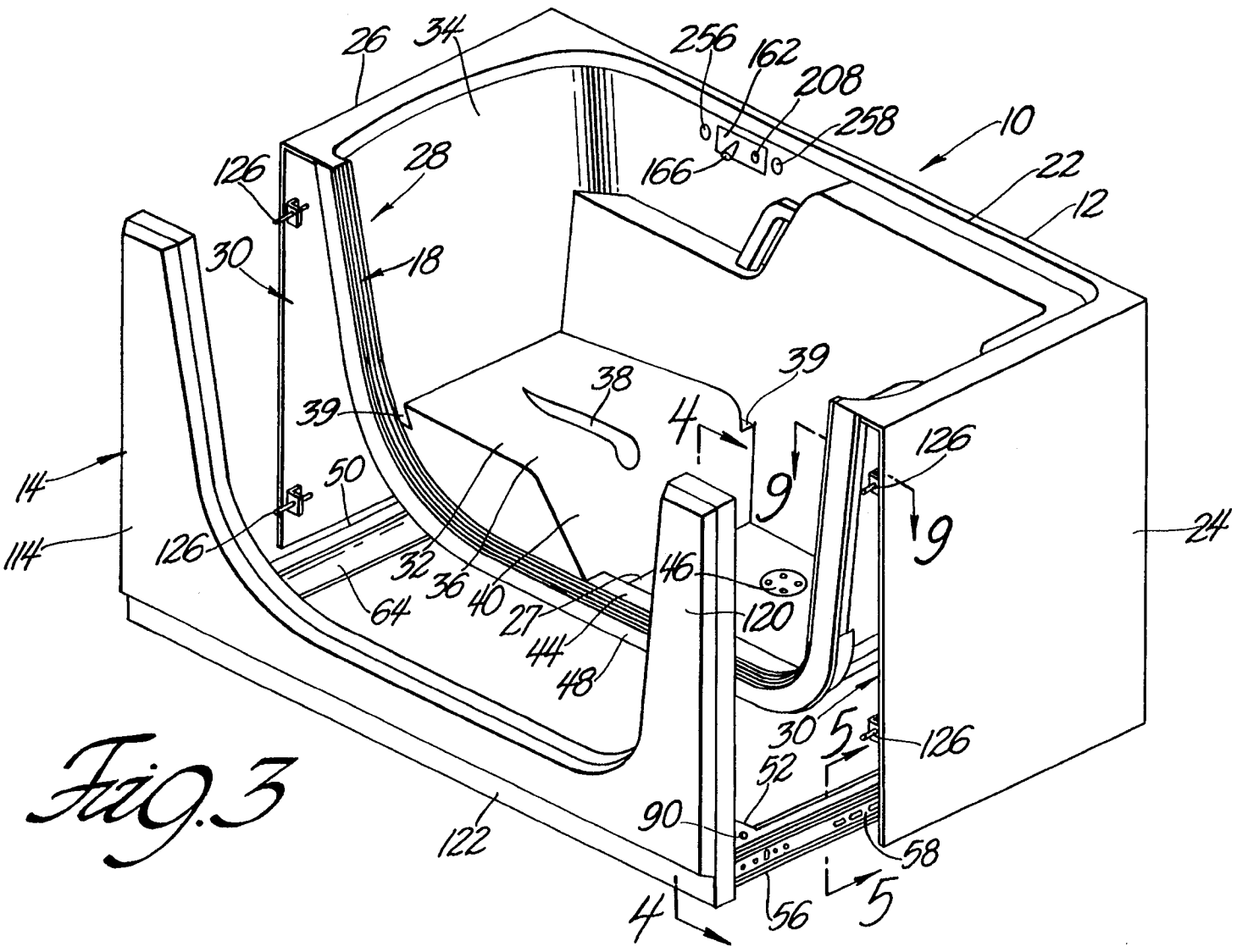

The open side 28 of the main tub body 12 is defined by a sealing surface 48. As shown in the drawing, the sealing surface 48 is in a generally vertical flat plane. If desired, the sealing surface could be in a plane that is inclined away from vertical. The sealing surface could also be arcuate rather than in a flat plane if necessary to produce the desired tub wall shape.

The door support frame 14 includes a generally L-shaped support frame member 52 supported on the first end wall 24 and a generally L-shaped support frame member 50 supported on the second end wall 26. The generally L-shaped support frame members 50 and 52 are supported on the first and second end walls 24 and 26 by industrial drawer slides 54. The drawer slides 54 include a channel member 56 attached to each of the generally L-shaped support frame members 50 and 52, a floating C-shaped channel 58 inside each channel member 56, and a channel member 60. One of the channel members 60 is attached to an inside surface of the first end wall 24 inside a cavity 30. The other channel member 60 is attached to an inside surface of the second end wall 26 inside a cavity 30. A plurality of ball bearings 62 are inserted in races formed between the channel member 56, and the floating C-shaped channel 58, and ball bearings 59 are inserted in races formed between the channel 60 and the floating C-shaped channel 58 of each drawer slide to support the L-shaped support frame members 50 and 52 and to allow the L-shaped support frame members to slide in and out of the cavities 30.

A tambour door assembly 16 is attached to the generally L-shaped support frame member 50 and 52 of the door support frame 14. The tambour door assembly 16 includes door guide assemblies 64, a tambour door 66, and a sprocket and counterbalance spring system 68. The door guide assemblies 64 are tracks that support and guide the ends of the tambour door 66. Each door guide assembly 64 includes a horizontal channel 70, a generally vertical channel 72, and an arcuate channel 74 connecting the horizontal channel to the generally vertical channel to form one continuous door guide. One of the door guide assemblies 64 is attached to the L-shaped support frame member 50 and the other door guide assembly is attached to the L-shaped support frame member 52 with the open sides of the channels facing toward each other.

The tambour door 66 includes ten elongated tambour slats 76. Each elongated tambour slat 76 is a fiberglass tube filled with rigid structural foam 77, except for a section at each end. A shaft 78 and shaft mounting block 80 is secured in the section of each end of each tambour slat 76 that is not filled with foam 77. A roller and bearing assembly 82 with a tire 84 made of rubber or some other material is attached to the free end of each shaft 78. The roller and bearing assemblies 82 are positioned in the door guide assemblies 64 and confine the tambour slats 76 to movement along a path determined by the shape of the door guide assemblies. The tires 84 on the roller and bearing assemblies 82 eliminate noise during movement of the tambour slats in the door guide assemblies 64. A flexible impervious membrane 86 is secured to the side of the tambour slats 76 which faces the sealing surface 48 on the open side 28 of the main tub body 12. The membrane 86 is a laminated sheet made from three layers of fiber cloth in a plastic matrix which provides a smooth surface that is easy to clean and is not damaged by various chemicals, such as bath oils and caustic tub cleaners, that might be used in bath water or to clean bath tubs. The three fiber cloth layers are unidirectional fiber net material that is sold under the trademark KEVLAR owned by New England Ropes Inc. or other material with similar properties. The membrane 86 is attached to the tambour slats 76 by rivets 88 or other suitable fasteners. The rivets 88 are near the ends of the tambour slats 76 and in the top and bottom tambour slats 76 where they are not normally in contact with water in the bath tub to eliminate possible leaks. The membrane 86 and the rivets 88 hold the ten tambour slats 76 in a side-by-side parallel position relative to each other. The membrane 86 is attached to the tambour slats 76 with the fibers, in the two outer cloth layers of unidirectional fiber net, parallel to the long axes of the tambour slats. The fibers, in the center cloth layer of unidirectional fiber net, are perpendicular to the fibers in the two outer layers and to the long axes of the tambour slats 76.

A sprocket and counterbalance spring system 68 includes a sprocket shaft 90 rotatably journaled on the generally L-shaped support frame members 50 and 52. A sprocket 92 is attached to each end of the sprocket shaft 90 adjacent to the arcuate channels 74 of the door guide assemblies 64. The sprockets 92 engage the shafts 78 that extend from the ends of each tambour slat 76. The sprockets 92 are secured to the sprocket shaft 90 so that they keep the tambour door 66 in alignment relative to the door guide assemblies 64 and prevent binding of the tambour door. A spacer 94 is provided on each shaft 78 adjacent to a mounting block 80 in the end of each tambour slat 76. The spacers 94 are between the two sprockets 92 when the shafts 90 the spacers are mounted on are in mesh with the sprockets. The spacers 94 thereby center the tambour door 66 between the sprockets 92.

Figure 11:
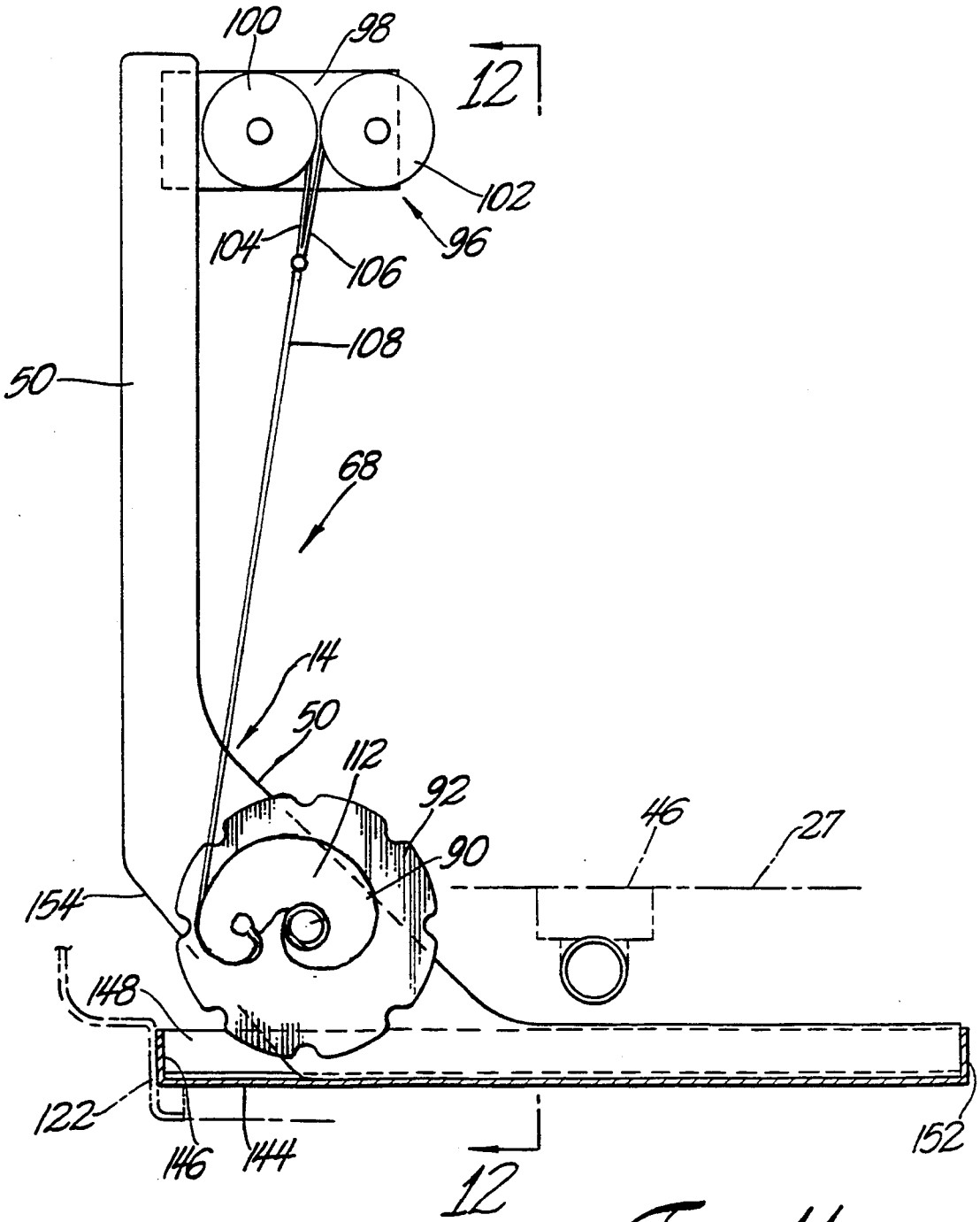
Figure 12:
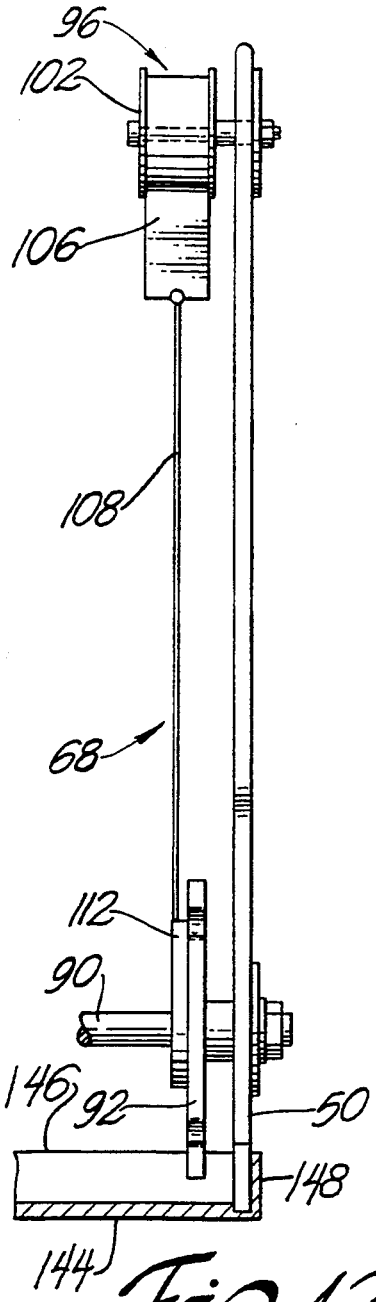
Figure 13:
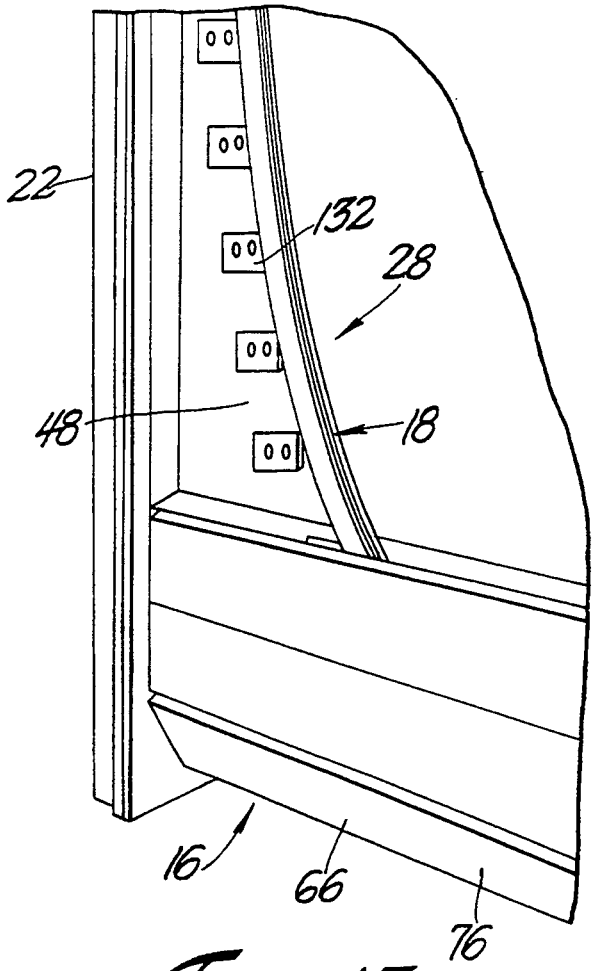
Figure 14:
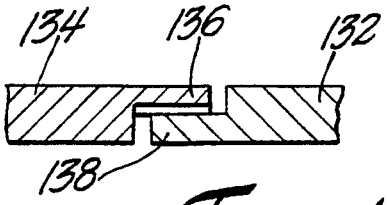
Figure 15:
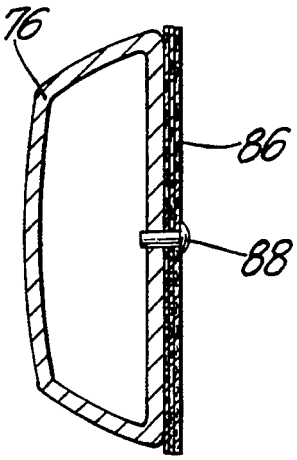
Figure 16:
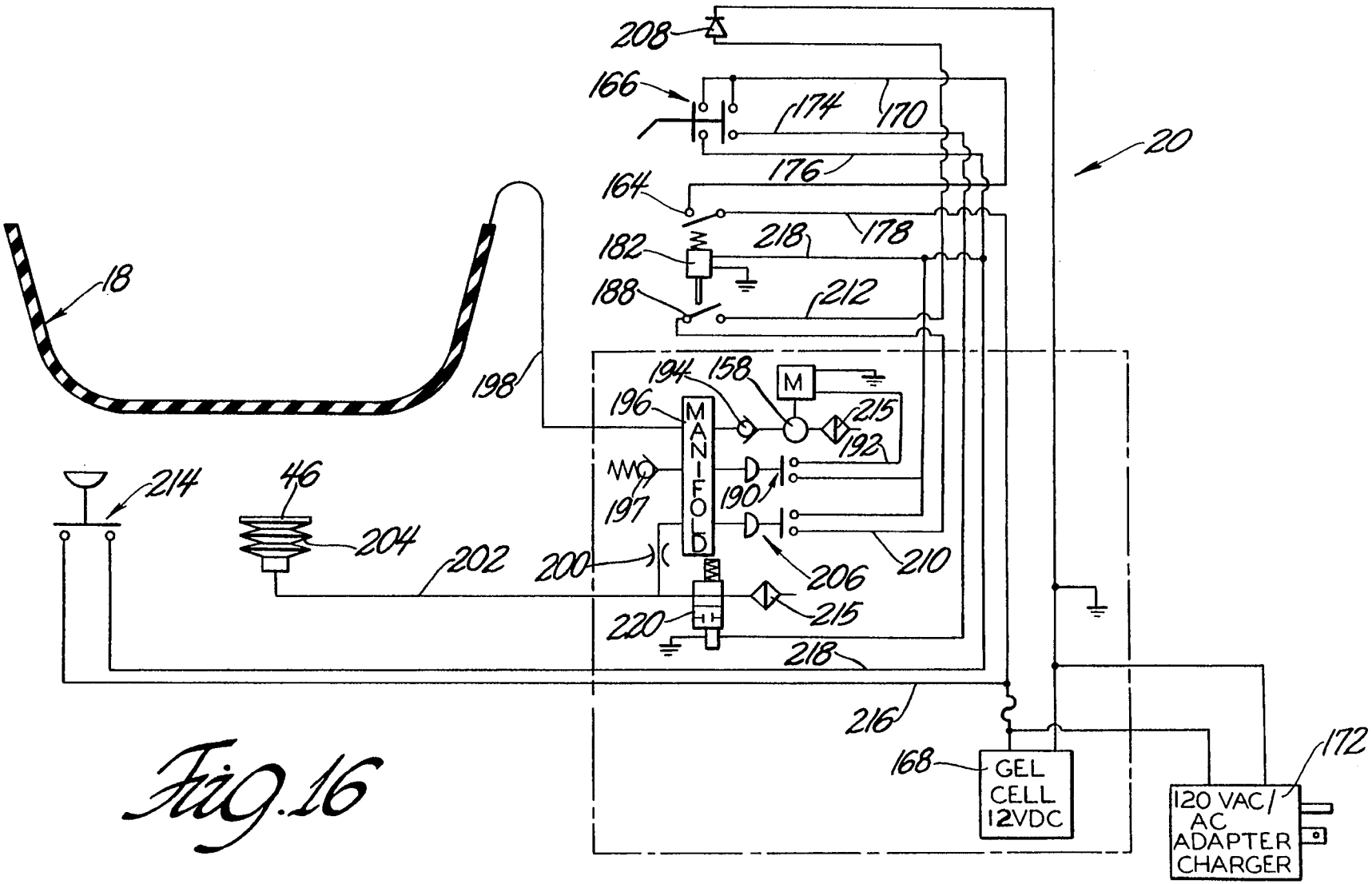

The counterbalance spring assembly 96 of the sprocket and counterbalance spring system 68 include a spring support plate 98 rigidly secured to the upper portion of one of the generally L-shaped support frame members 50 or 52. Two take-up spools 100 and 102 are rotatably attached to the spring support plate 98. A stainless steel ribbon linear force spring 104 is attached to the take-up spool 100 and a stainless steel ribbon linear force spring 106 is attached to the take-up spool 102. The linear force springs 104 and 106 tend to coil and rotate the take-up spools 100 and 102 in opposite directions and roll up into separate coils on the take-up spools to which they are attached. The force exerted by the linear force springs is substantially constant regardless of position as the springs uncoil from the take-up spools 100 and 102 or coil on to the take-up spools. The free ends of the linear force springs 104 and 106 are attached together by a cable 108. The cable 108 is attached to the sprocket 92 at a point 110 near the perimeter of the sprocket on an eccentric cam 112 on one side of the sprocket. The linear force springs 104 and 106 counterbalance the weight of the tambour door 66 at all positions of the tambour door in the door guide assemblies 64. When the tambour door 66 is fully open and is supported under the floor 27 of the main tub body 12 there is very little weight for the linear force springs 104 and 106 to support. The cable 108 is wrapped around and in contact with all or most of the eccentric cam 112. As the tambour door 66 moves from the fully open position, where it is under the floor 27, toward the fully closed position adjacent to the sealing surface 48, the cable 108 unwinds from the eccentric cam 112 and the linear force springs 104 and 106 wrap around the take-up spools 100 and 102. The eccentric cam 112 increases the effective moment arm as the tambour door is raised. As the tambour door 66 approaches the fully closed position, as shown in FIG. 11, the linear force springs 104 and 106 act on a portion of the eccentric cam 112 with a maximum radius and support the entire weight of the tambour door. This arrangement effectively counterbalances the weight of the tambour door and makes it possible to move the tambour door from the open position to the closed position with a small, essentially constant force. The tambour door 66 can also be closed with a small, essentially constant force.

The door support frame 14 includes a valance 114 attached to the generally L-shaped support frame members 50 and 52. The valance 114 includes a generally horizontal section 116, vertical end sections 118 and 120, and a recessed toe plate 122 along the bottom. The valance 114 essentially surrounds the open side 28 of the main tub body 12 without reducing the size of the opening for ingress or egress by a bather. The valance 114 forms a portion of the door support frame 14, covers the door guide assemblies 64, and can contact the tambour slats 76 to limit lateral movement of the tambour door 66 away from the sealing surface 48.

Figure 4:
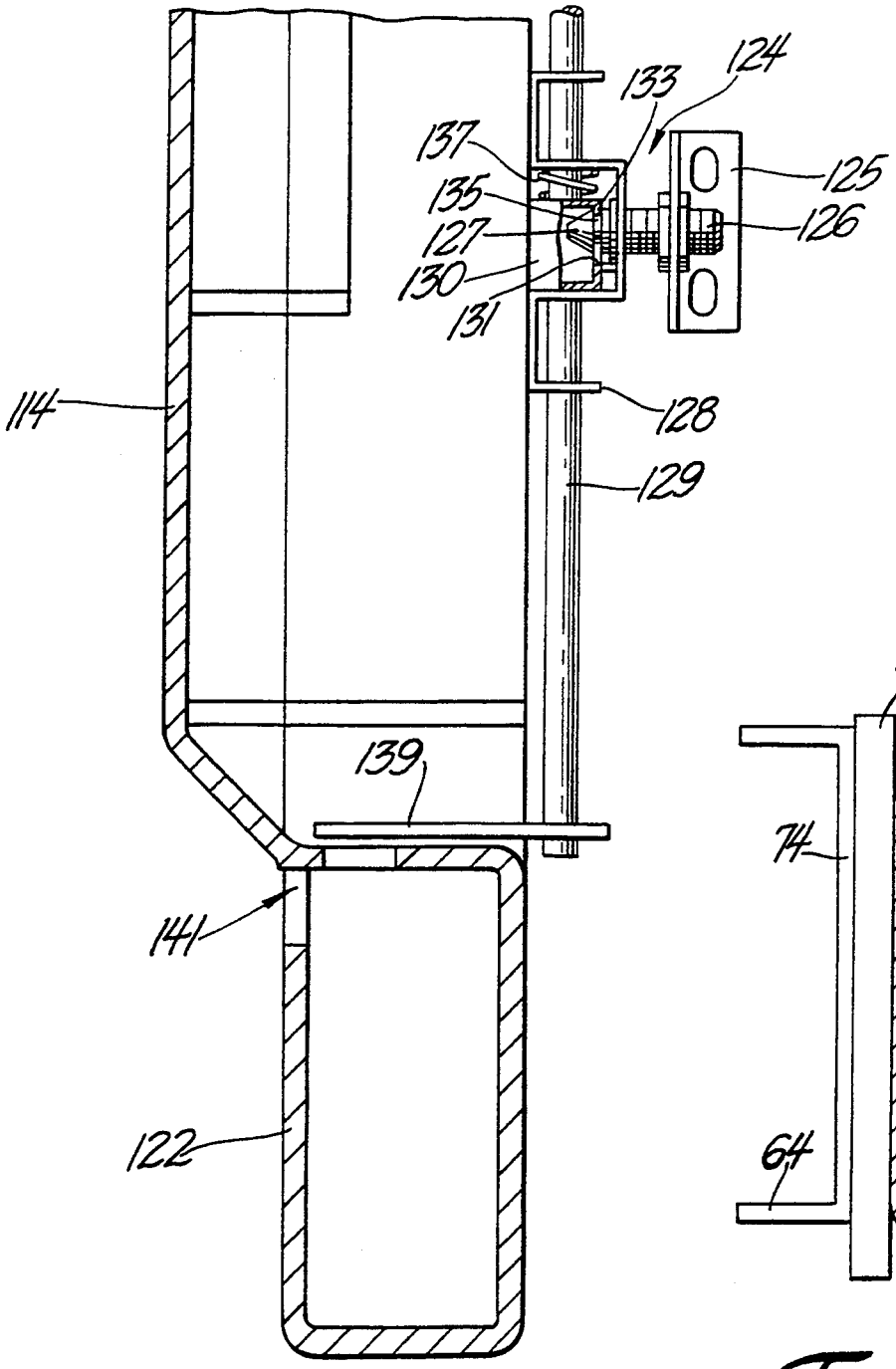
Figure 5:
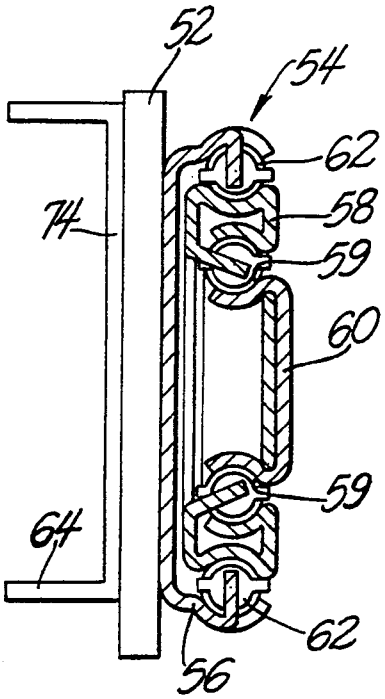

The door support frame 14 is locked into a closed position by a pair of pin slam locks 124 at each end of the valance 114 of the door support frame. Only the lower pin slam lock 124 is shown in FIG. 4. Each pin slam lock includes a bracket 125 secured to the first and second end walls 24 and 26 inside the cavities 30. A pin 126 is screwed into each bracket 125 with a conical end 127 projecting horizontally away from the main tub section 12 and toward the valance 114. A latch support bracket 128 is secured to the door support frame 14 in alignment with each of the four pins 126. A vertical rod 129 passes through the two latch support brackets 128, on the end of the door support frame, which are in alignment with the two pins 126 secured to first end wall 24. An identical vertical rod 129 passes through the two latch support brackets 128, on the end of the door support frame, which are in alignment with the two pins 126 secured to the second end wall 24. A latch 130 with a pin receiving aperture 131 is connected to the rod 129 and positioned within each latch support bracket 128. When the door support frame 14 is moved toward the main tub body 12 on the drawer slides 54, the conical ends 127 of each pin 126 enter the pin receiving aperture 131 and cam the latch 130 to a position which allows the conical end to move into the latch. After the pin 126 has moved all the way into the latch 130 it is in alignment with, a lip 133 of the pin receiving aperture 131 moves into a groove 135 at the base of the conical end 127 of the pin 126 and locks the door support frame 14 in a closed position. Springs 137 bias the lips 133 of the latches 130 into the grooves 135 to latch the door support frame 14 to the main tub body 12. An arm 139 is provided on the bottom end of each rod 129 as shown in FIG. 4. The arm 139 is lifted to raise the rod 129 and to raise the two latches 130 connected to the rod and release the pins 126. Both rods 129 have to be raised to release all four pins 126 before the support frame 14 can move horizontally away from the main tub body 12. The arms 139 are lifted manually by inserting a finger or a tool through each of the openings 141. Adjustment of the pins 126 in the brackets 125 position the tambour door 66 in the proper position relative to the sealing surface 48. The valance 114 is adjacent to the tambour slats 76 when the tambour door is closed and limits movement of the tambour slats 76 away from the main tub body 12.

An optional system for limiting lateral movement of the tambour door 66 away from the sealing surface 48 includes a plurality of retainer tabs 132 secured to the sealing surface 48 at the ends of the open side 28 and a plurality of retainer tabs 134 attached to the sides of the tambour door 66. A plurality of retainer tabs 132 are also secured to the sealing surface 48 across the bottom portion of the open side 28 of the main tub section 12 and a plurality of retainer tabs 134 are attached to the bottom tambour slat or slats 76 of the tambour door 66. The retainer tabs 134 have an end projection 136 which slides behind an end projection 138 on the retainer tabs 132 when the tambour door 66 is closed and the retainer tabs 132 and 134 are side by side. When the tambour door 66 is fully closed the retainer tabs 132 cooperate with the retainer tabs 134 to limit horizontal movement of the tambour door 66 away from the sealing surface 48.

Figure 6:
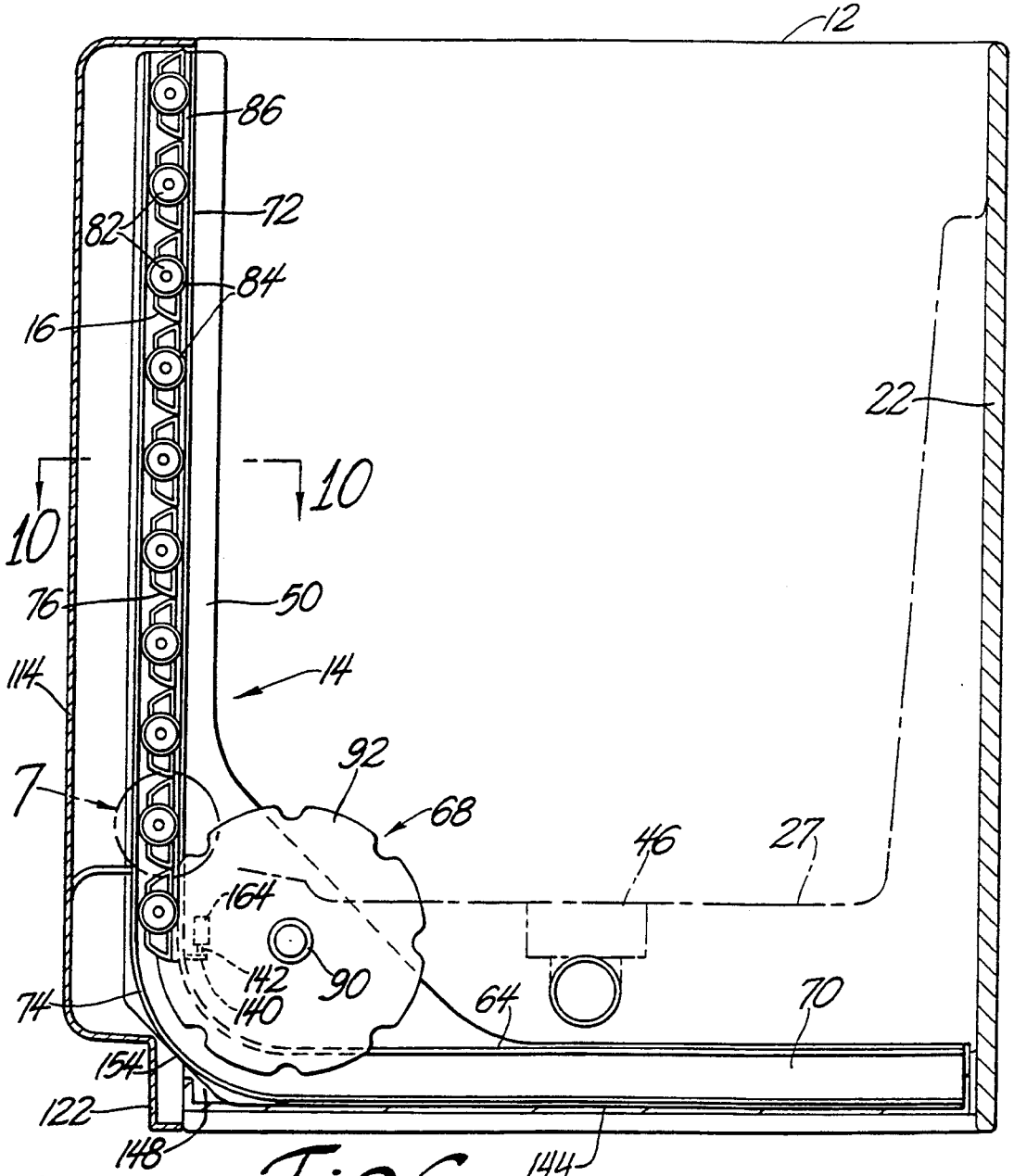
Figure 7:
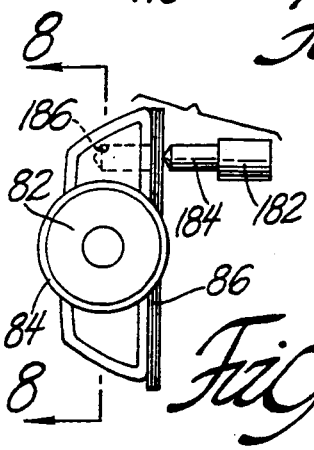
Figure 8:
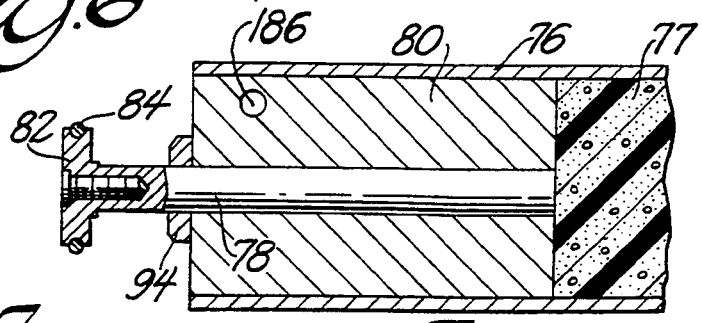

The bottom tambour slat 76 of the tambour door 66 has an angle member 140 attached and extending inwardly toward the main tub body 12. The bottom tambour slat 76 is strengthened by the angle member 140 and is held adjacent to the main tub body when the tambour door 66 is closed. The angle member 140 also engages a stop 142 on the bottom of the main tub body 12 near the sealing surface 48. The engagement between the angle member 140 and the stop 142 stops upward movement of the tambour door 66 as shown in FIG. 6. Upward movement of the tambour door 66 could also be stopped by retainer tabs 132 and 134 or by contact between the top of the tambour door 66 and the valance 114. The angle member 140 and the stop 142 make contact and stop movement of the tambour door 66 while the pins 78 extending from the bottom tambour slat 76 are in engagement with the sprockets 92. The sprockets 92 remain in mesh with the pins 78 at all times to keep the eccentric cam 112 timed relative to the tambour door 66.

A fiberglass reinforced plastic drip pan 144 is positioned under the main tub body 12 and the door guide assemblies 64 to catch any water that drips from the tambour door 66. The drip pan 144 slides out with the door support frame 14 when the pin slam locks 124 are unlatched to release the door support frame 14 and the support frame is moved laterally away from the sealing surface 48 on the door slides 54. The fiberglass reinforced plastic drip pan 144 slides back under the main tub body 12 when the door support frame 14 is slid back toward the main tub body and locked into position by the pin slam locks 124. The fiberglass reinforced plastic drip pan 144 has a front wall 146, end walls 148 and 150, and a rear wall 152. The front wall 146 is positioned in a notch 154 between the lower front corner of each generally L-shaped support frame member 50 and 52 and the back side of the toe plate 122 of the valance 114. The L-shaped support frame members 50 and 52 are positioned between the end walls 148 and 150 and partially inside the fiberglass reinforced plastic drip pan 144. If desired the fiberglass reinforced drip pan 144 can be attached to the L-shaped support frame members 50 and 52 by bolts or other fasteners.

Figure 17:
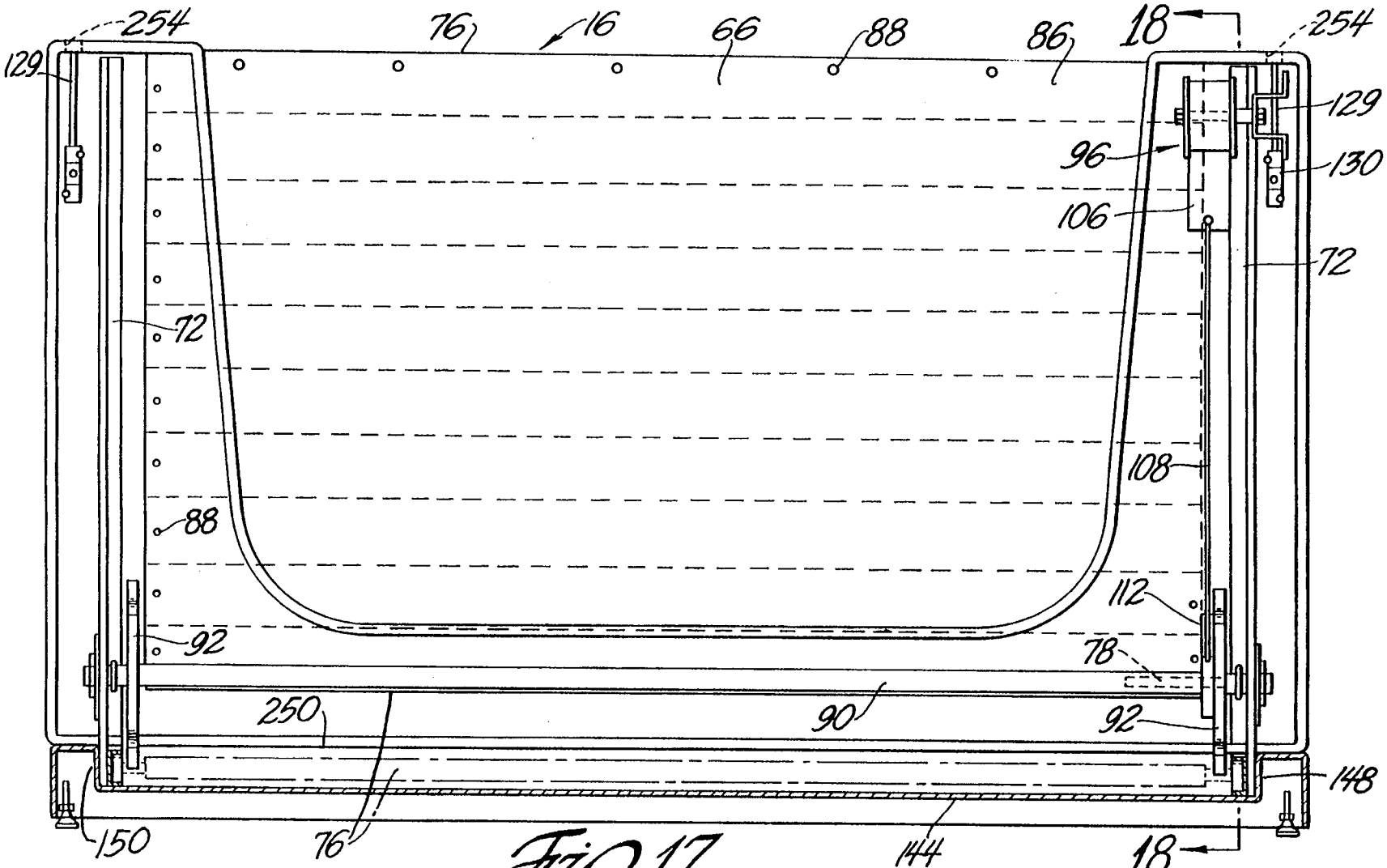
Figure 18:
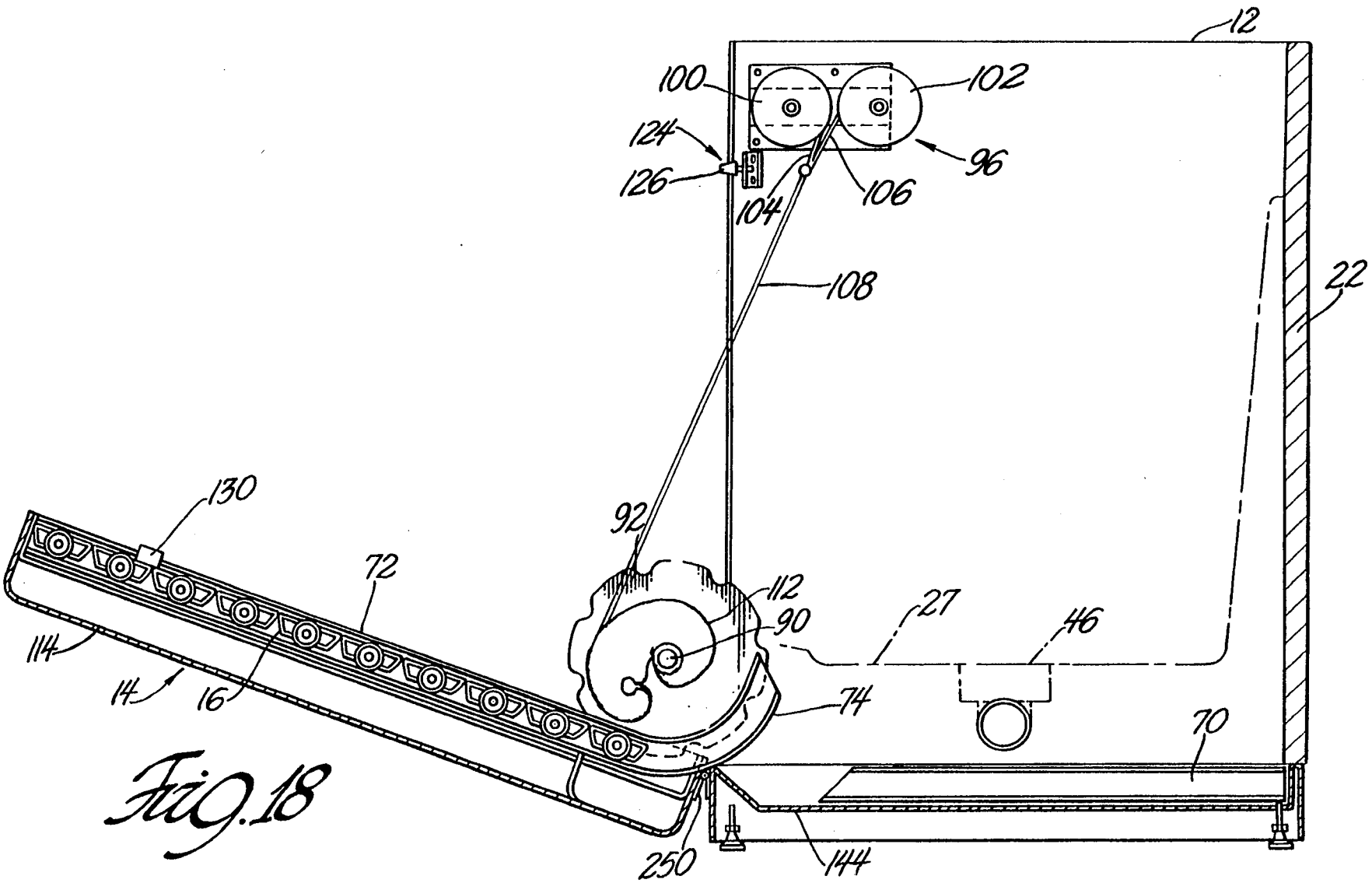

The door support frame 14 can be pivotally attached to the main tub section 12 as shown in FIGS. 17 and 18 if desired. When the door support frame 14 is pivotally attached, the drip pan 144 is an integral part of the main tub section 12. The drip pan 144 is integral with the first end wall 24, the second end wall 26, and the side wall 22. The recessed toe plate 122 is separate from the valance 114 and is an integral part of the drip pan 144 and the main tub section 12. The valance 114 is pivotally attached to the recessed toe plate 122 by a piano hinge 250. The door guide assemblies 64 have horizontal channels 70 that are secured to the main tub section 12 inside the drip pan 144. The vertical channels 72 and the arcuate channels 74 of the door guide assemblies 64 are secured to the valance 114 and pivot with the valance. The L-shaped support frame members 50 and 52 are not required. The two take-up spools 100 and 102 are attached to the second end wall 26 inside the cavity 30 rather than to one of the L-shaped support frame members 50 or 52. With the piano hinge 250 securing the valance 114 to the main tub section 112 along the entire length of the valance, only one pin slam lock 124 is required at each end of the valance. When the pivotally attached door support frame 14 and the valance 114 are locked to the main tub section 12 by the pin slam locks 124, the horizontal channels 70 are adjacent to the vertical channels 72 and the arcuate channels 74 to form continuous door guide assemblies 64. With this construction the vertical rod 129 for each pin slam lock 124 extends up from the latch 130 to the top of the valance 114. The latches 130 are unlatched by inserting a tool or a finger into apertures 254 in the top of the valance and forcing the vertical rods 129 and the attached latches 130 downward to unlatched positions. The springs 137 bias the latches 130 upwardly to a latched position, rather than downwardly, as described above and shown in FIG. 4. A locking system can be provided to prevent inadvertent release of the latches 130 if needed. The pin slam locks 124 are unlocked from the bottom of the valance as shown in FIG. 4 and from the top as shown in FIG. 17. The pin slam locks 124 as shown in FIG. 4 could be mounted to be released from the top if desired and the pin slam locks shown in FIG. 17 could be mounted to be released from the bottom if desired. The elongated tambour slat 76 shown in phantom lines inside the drip pan 144 in FIG. 17 shows the position of the tambour slats when the tambour door 66 is open. When the tambour door 66 is closed as shown in FIG.

17, the lowermost tambour slat 76 is at about the same height as the sprocket shaft 90. The door support frame 14 and the tambour door 66 are essentially identical in both embodiments except for the differences discussed in this paragraph. Operation is different, however, in that the tambour door 66 is to be fully closed when the door support frame 14 is pivoted to the position shown in FIG. 18. When the valance is pivoted down and away from the main tub section 12, there is adequate access for cleaning, adjustment and maintenance.

Figure 9:
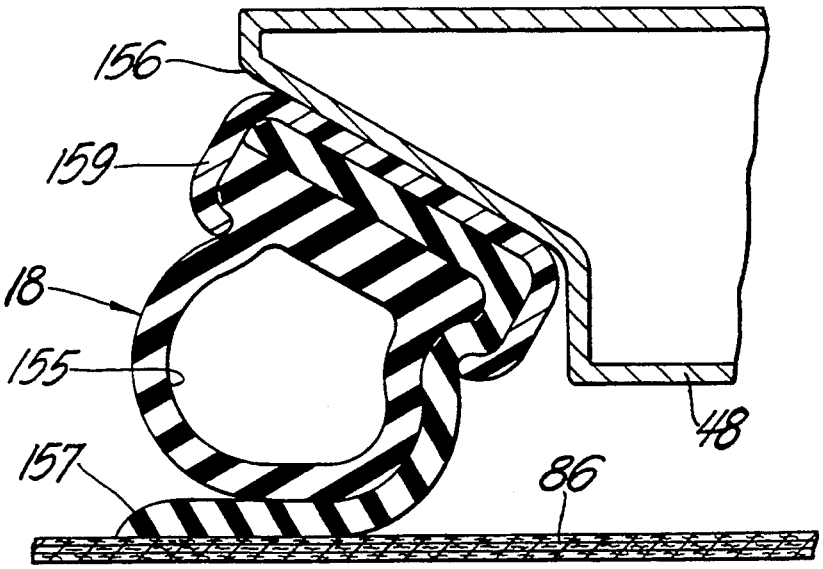
Figure 10:
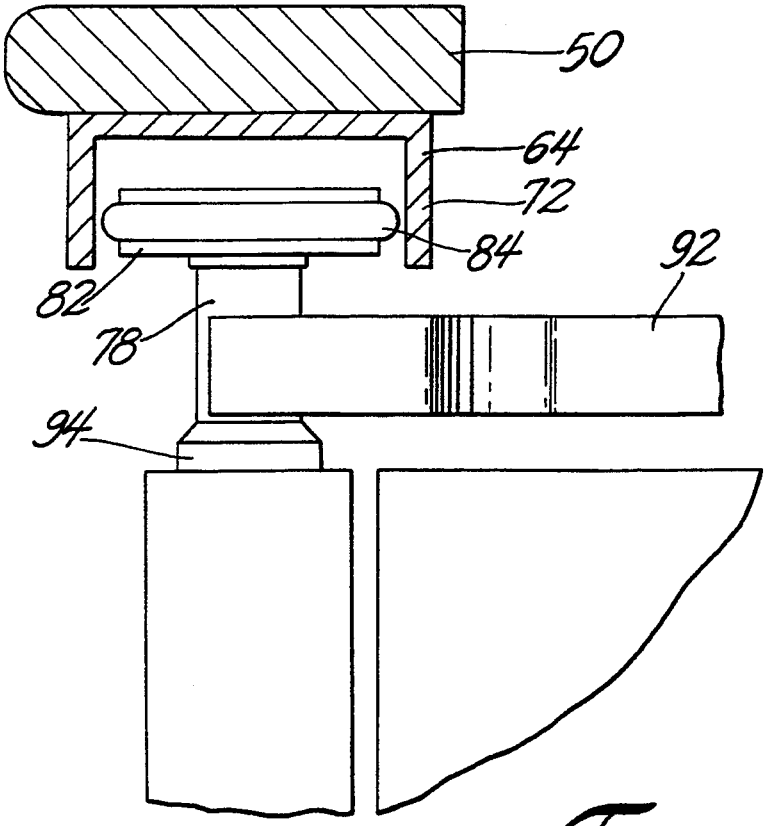

A seal 18 is attached to a beveled surface 156 between the sealing surface 48 and inside surfaces of the main tub body 12 that define the ingress and egress opening. The seal 18 can be attached to the beveled surface 156 by adhesives or by mechanical fasteners and a channel 159. The beveled surface 156, as shown in the drawing is at the proper angle relative to the sealing surface 48 to accommodate seal 18. By changing the seal 18, the angle of the beveled surface 156 can be changed and could even be parallel to or perpendicular to the sealing surface 48. The seal 18 as shown in FIG. 9 includes a tubular member 155 that is connected to a fluid pump 158 and pressurized after the tambour door 66 is closed and before the tub 10 is filled with water. Pressurizing the seal 18 insures that the seal is tight against the membrane 86 of the tambour door 66 and does not leak. The seal 18 also includes a lip seal 157 that is held against the tambour door 66 by water pressure from water in the tub and will not leak, even if the tubular member 155 loses pressure. The seal 18 will allow the tambour door 66 to slide relative to the seal and open when the pressure of water against the seal is released by draining water from the tub and compressed fluid in the tubular member 155 of the seal is allowed to escape. A seal 18 which remains in sliding contact with the tambour door 66 when the door is opened is treated with a material that reduces friction to reduce seal wear. However, if desired the tubular member 155 of the seal 18 can be connected to a vacuum pump (not shown) which pumps fluid from the tubular member, thereby collapsing the tubular member, and pulling the tubular member away from the tambour door 66. By pulling the tubular member 155 away from the tambour door 66, pressure exerted on the tambour door by the seal 18 is reduced and the force required to open the tambour door is decreased.

Figure 19:
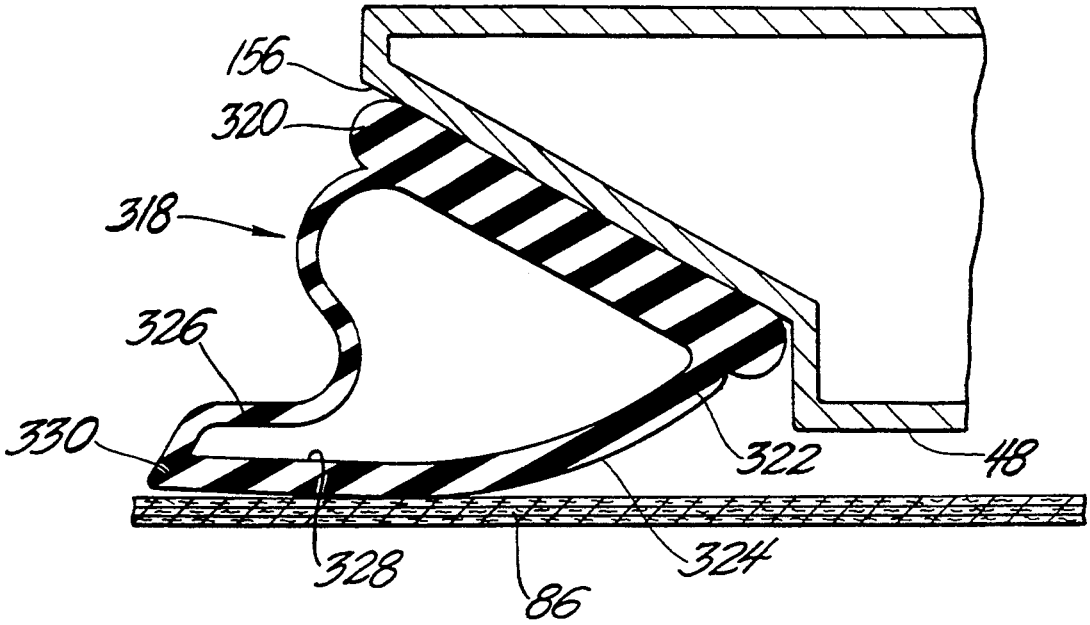

The seal 18 as described above is a two part seal. One part is the tubular member 155. The other part is the lip seal 157. An alternate one piece seal 318 is shown in FIG. 19. The seal 318 includes a semirigid base 320 that is attached to the beveled surface 156. A channel 159 could be used to attach the one piece seal 318 the same way the seal 18 is attached if desired. A wall section 322 extends outwardly from the semirigid base 320. The outer surface 324 of the wall section 322 makes sealing contact with the flexible impervious membrane 86. A flexible wall section 326 extends from the wall section 322 to the semirigid base 320 to complete a tube 328. When the tube 328 is inflated by fluid under pressure, the outer surface 324 is forced into sealing contact with the membrane 86. If the tube 328 is deflated while there is water in the tub 10, water pressure forces the flexible wall section in toward the center of the tube 328 and forces the end 330 of the wall section 322 remote from the semirigid base 320 into sealing contact with the membrane 86 and holds it in contact until water is drained from the tub. The wall section 322 is thicker than the wall section 326. This added thickness provides sufficient rigidity to allow the seal 318 to maintain its shape when the tambour door 66 is opened and closed.

A control system 20 is provided to control the operation of the tub 10. The control system includes a control panel 162. The control panel 162 can be tailored to meet the requirements of the person using the tub 10. However, the functions which must be controlled remain essentially the same. Following entry into the tub 10, the person desiring to bathe manually raises the tambour door 66 to a closed position. If desired or required, however, by the person desiring to bathe, a power source, such as an electric motor (not shown), could be employed to rotate the shaft 90, turn the sprockets 92, and raise the tambour door 66. If an electric motor or other power source were used, the counterbalance spring system 68 may not be required. However, if the counterbalance spring system 68 is used, a smaller electric motor can be used. When the tambour door 66 is closed, a door switch 164 is automatically activated and line 178 is connected to line 170 and the bathe/drain switch 166 is energized. Nothing normally occurs upon activation of the door switch 164. The person desiring to bathe activates the tub bathe/drain switch 166 to the bathe position. With the bathe/drain switch 166 in the bathe position and the tambour door 66 closed, current from a line 170, door switch 164 and line 178 connected to a battery 168 and an adaptor 172 that converts alternating current to direct current, energizes the line 176 and the line 174. Line 174 energizes the normally open solenoid valve 220 thereby causing the valve to close, and deventing the fluid circuit. The line 176 energizes one or more solenoids 182 which lock the tambour door 66 in the closed position by forcing a rod 184 into a bore 186 in a tambour slat 76. Movement of the rod 184 of the solenoid 182 into the bore 186 closes the latch switch 188. The line 176 is connected to the line 218 and to the first pressure switch 190 which is normally closed and connects the line 212 to the line 192 which energizes the pump motor M and the pump 158. The pump 158 supplies compressed fluid through a check valve 194 to a manifold 196. The manifold 196 has a pressure relief valve 197 to prevent overpressurization. The manifold 196 supplies compressed fluid to a line 198 that supplies compressed fluid to the tubular member 155 of the seal 18 and expands the seal. The manifold 196 also supplies compressed fluid through a restricter 200 and a line 202 to a fluid drain bellows 204 which closes the drain 46. The restricter 200 insures that the seal 18 is pressurized before the drain bellows 204 completely closes the drain 46. When the drain 46 is closed, the bellows 204 pressurized, and the seal 18 pressurized, the second pressure switch 206 is closed, line 218 is connected to line 210 which is in turn connected to line 212 through latch switch 188, and a light 208 on the control panel 162 is thereby turned on. The light 208 indicates that the bath tub 10 is ready to be filled and the valves for filling the tub can be opened. The bath tub is filled by opening valve 256 for hot water and valve 258 for cold water. The water which passes through the valves 256 and 258 enters the bath tub 10 through a pipe and fixture (not shown) on the first end wall 24. It should be recognized, however, that the point of entry of water into the tub can be changed to meet the requirements of the person using the bath tub.

The water level switch 214 which is normally open, is closed as the water level in the tub 10 rises. The closed water level switch 214 connects line 216 to line 218 and energizes the solenoids 182 and the pump 158 through pressure switch 190 as long as there is water above a predetermined level in the tub 10. The pressure switch 190 opens and turns off the pump 158 when the pressure in the manifold reaches an operating level. If the pressure in the manifold 196 drops below a predetermined level, the pressure switch 190 closes and the pump 158 pumps fluid into the manifold.

A bather activates the tub bathe/drain switch 166 to the drain position after completing a bath. This activation of the bathe/drain switch 166 breaks the connection between the lines 170 and 178 from the power source to the line 176 and the line 218 to the solenoids 182. However, the solenoids 182 and the pump 158 remain energized through the lines 216 and 218 and the water level switch 214 thereby keeping the tambour door 66 locked in the closed position and sealed. Disconnection of the line 170 from the line 174 by moving the tub bathe/drain switch 166 to a drain position de-energizes the solenoid valve 220. The solenoid valve 220 is opened when it is de-energized to vent pressurized fluid from the fluid drain bellows 204 through the filter 215 and thereby drain water from the tub 10. The restricter 200 and the operation of pump 158 through pressure switch 190 keeps the tubular member 155 of the tub seal 18 pressurized while water drains from the tub. When the water level in the tub drops below the level of the bottom of the tambour door 66, the water level switch 214 is opened. Opening the water level switch 214 de-energizes the solenoids 182 and unlocks the tambour door 66 and de-energizes the pump 158. The restricter 200 allows compressed fluid to escape from the tub seal 18 and the tambour door 66 can be manually opened by pressing down on the top tambour slat 76. When the tambour door opens, the door switch 164 opens. If desired, a fluid evacuation pump (not shown) can be provided to pump fluid from the tubular member 155 of the seal 18 after the water level switch opens.

Filters 215 can be provided to filter fluid drawn into the system by the fluid pump 158 or through solenoid valve 220. Filters 215 can also be used to muffle fluid escaping from the solenoid valve 220. Fluid would only be drawn through the solenoid valve 220 when a fluid evacuation pump is connected to the manifold 196.

The primary power source for the control system 20 is through the adaptor 172 that converts alternating current to direct current. In the event that there is a power failure which cuts off power from the adaptor 172, the gel cell battery 168 will supply current to operate the control system 20. In the unlikely event that there is a failure of both power sources, the solenoid valve 220 will open, and the solenoids 182 will be de-energized. When the solenoid valve 220 is open, the drain bellows 204 is de-pressurized thereby opening the drain 46 and the compressed fluid in the tub seal 18 escapes. De-energizing the solenoids 182 allows return springs in the solenoids to withdraw the rods 184 from the bores 186 in tambour slats 76 thereby unlocking the tambour door 66. The tambour door 66 can then be opened. This design of the solenoid valve 220 and the solenoids 182 insures that a bather is not locked in the bath tub 10 even if there is a complete electrical failure.

The fluid pumped into the manifold 196 by the pump 158 is preferably air. However, another gas could be used if desired. It would also be possible to use a liquid to operate the drain bellows 204 and to pressurize the seal 18.

The bath tub 10 has been described above as a stationary unit that can be moved through standard sized doors and installed in a space for a standard size conventional bath tub. The bath tub 10 can also be mounted on a wheeled carriage and transported to various locations where a person desires to bathe. When the bath tub 10 is mounted on a wheeled carriage, a holding tank for warm water, as well as a holding tank for waste water, can be mounted on the carriage with the bath tub. Pipes with quick disconnects could also be employed to supply water to a tub and to carry waste water from the tub. When pipes with quick disconnects are used, holding tanks for clean water and for waste water are not required. However, with the bath tub 10 mounted on a carriage and with pipes having quick disconnects, it is generally necessary to add a pump for waste water removal so that waste water can be pumped up and out of the tub when a floor drain is not available. An electrical connection for the waste water pump is also required.

The control system 20 could, if desired, include a microprocessor. With a microprocessor it would be possible to expand the control functions to include water temperature, a power door opener, timers, pumps, lights, water level and others. Water temperature control could include inlet water temperature control as well as control of heaters to maintain or increase water temperature. Timers could automatically open the drain and the door after a person has been in the tub the desired time and could send a signal to a remote location indicating that the bather is ready to leave the tub. Pumps could provide a whirlpool with a programmed therapeutic action to fit the requirements of a person using the tub. Water level control could control water level according to the size of a bather and to meet the therapeutic requirements of a bather.

The invention has been described in connection with a preferred embodiment, but is intended to be illustrative rather than definitive thereof and the true scope of the invention is defined by the following claims.

We claim:

1. A bath tub having side access to facilitate ingress and egress including a main tub section with a fixed side wall, a pair of fixed end walls integral with the fixed side wall, a bottom wall integral with the fixed side wall and the pair of fixed end walls, a drain for the bottom of said main tub section and an open side having a sealing surface, said open side being integral with said end walls and said bottom wall, and located opposite said fixed side wall; a tambour door assembly including a tambour door, and a track assembly with generally vertical guides supported on the open side of the main tub section and generally horizontal guides supported below the bottom wall of the main tub section, said door having a plurality of parallel tambour slats faced by a flexible water impervious membrane substantially covering one side of the parallel tambour slats, and being guided by the track assembly in movement between a first position generally under the bottom wall in which the open side of the tub is open and a second position adjacent to the open side of the main tub section in which the open side of the tub is closed; and a seal in contact with said sealing surface on the main tub section and in contact with the flexible impervious membrane of the tambour door when the tambour door is in said second position for preventing water loss.

2. A bath tub having side access as set forth in claim 1 including a lock for locking the tambour door in a position in which the open side of the main tub section is closed.

3. A bath tub having side access as set forth in claim 2 including a control system with a water level sensor that senses the water level in the bath tub and keeps the tambour door locked in a closed position until the level of water in the tub is below a predetermined level.

4. A bath tub having side access as set forth in claim 2 including a control system with a tub drain that is closed by the control system only when the tambour door is locked in the closed position.

5. A bath tub having side access as set forth in claim 1 wherein the seal which seals between the main tub section and the impervious membrane includes an elongated inflatable tube.

6. A bath tub having side access as set forth in claim 5 wherein the seal includes a protecting lip seal that is held in sealing contact with the tambour door by water pressure.

7. A bath tub having side access as set forth in claim 5 including a control system that keeps the tambour door locked in the closed position until said inflatable tube is deflated.

8. A bath tub having side access as set forth in claim 5 wherein the seal includes a lip seal with a flexible lip having one side that makes direct contact with the flexible impervious membrane and an opposite side which is in direct contact with water in the bath tub and the pressure of water against said opposite side of the lip holds said one side in sealing contact with the flexible impervious membrane.

9. A bath tub having side access as set forth in claim 5 including a control system that holds the tambour door in the closed position and keeps the inflatable tube inflated until the water level in the bath tub is below a predetermined level.

10. A bath tub having side access as set forth in claim 5 including a pump connected to the inflatable elongated tube and operable to inflate the tube to seal between the flexible impervious membrane of the tambour door and the main tub section.

11. A bath tub having side access as set forth in claim 1 including a retainer system that limits movement of the tambour door away from the main tub section when the tambour door is positioned adjacent to the sealing surface on the main tub section and the open side is closed.

12. A bath tub having side access as set forth in claim 8 wherein the door has an interior side and an exterior side and the retainer system that limits movement of the tambour door away from the main tub section when the tambour door is positioned adjacent to the sealing surface on the main tub section, includes a valance assembly supported adjacent to the exterior side of the tambour door and a valance support assembly for holding the valance in a fixed position relative to the main tub section during tub use.

13. A bath tub having side access as set forth in claim 11 wherein the retainer system that limits movement of the tambour door away from the main tub section when the tambour door is positioned adjacent to the sealing surface on the main tub section, includes at least one fixed member attached to the main tub section and a moveable member attached to the tambour door assembly and operable to engage the fixed member when the tambour door is positioned adjacent to the sealing surface on the main tub section and the open side is closed.

14. A bath tub having side access as set forth in claim 11 wherein the retainer system that limits movement of the tambour door away from the main tub section when the tambour door is positioned adjacent to the sealing surface on the main tub section, includes a valance assembly attached to the main tub section and positioned adjacent to the side of the tambour door that faces away from the main tub section.

15. A bath tub having side access as set forth in claim 14 wherein the valance assembly is secured to the main tub section by at least one releasable latch.

16. A bath tub having side access as set forth in claim 1 wherein the tambour door includes a support frame member supported on the main tub section adjacent to each fixed end wall of the main tub section, said door has teeth engaging surfaces, a shaft is rotatably journaled on the two support frame members, and a sprocket is secured to each end of the shaft in mesh with said teeth engaging surfaces on the tambour door to keep the tambour door in alignment with the track assembly.

17. A bath tub having side access as set forth in claim 16 including one or more spring members that tend to rotate said shaft in a direction which tends to balance the weight of the tambour door as it is moved toward a closed position.

18. A bath tub having side access as set forth in claim 16 including a valance assembly adjacent to the side of the tambour door that faces away from the main tub section and attached to the support frame members adjacent to each fixed end wall.

19. A bath tub having side access as set forth in claim 18 wherein the support frame members adjacent to each fixed end wall are connected to the main tub section by generally horizontal slides which allow the support frame members, the attached tambour door and the attached valance assembly to slide horizontally away from the main tub section for cleaning and maintenance.

20. A bath tub having side access as set forth in claim 19 including latches to latch the support frame member in an operating position relative to the main tub section.

21. A bath tub having side access as set forth in claim 19 including a sanitary drip pan under the tambour door assembly for catching any water which drips from the tambour door when the tambour door assembly is in position generally under the floor of the main tub section and the open side of the main tub section is open.

22. A bath tub having side access as set forth in claim 1 wherein the tambour door includes a door support frame to which the generally vertical guides of the track assembly are attached, a pivot member pivotally attaching the door support frame to the main tub section and one or more latches for latching the door support frame to the open side of the main tub section.

23. A bath tub having side access as set forth in claim 22 wherein the pivot member pivotally attaching the door support frame to the main tub section has a generally horizontal pivot axis.

24. A bath tub having side access as set forth in claim 1 including a constraint system for holding the tambour door in a position in which the open side of the main tub section is closed.

25. A bath tub having side access as set forth in claim 24 including a control system with a water level sensor that senses the water level in the bath tub and keeps the constraint system activated and holding the tambour door in a closed position until the level of water in the tub is below a predetermined level.

26. A bath tub having side access as set forth in claim 1 wherein the tambour door assembly includes a shaft rotatably supported adjacent to the track assembly and a sprocket secured to each end of the shaft and in mesh with the tambour door to keep the tambour door in alignment with the track assembly.

27. A bath tub having side access as set forth in claim 26 including one or more spring members that tend to rotate said shaft in a direction that moves the tambour door toward a closed position to counterbalance the weight of the door.

28. A bath tub having side access as set forth in claim 26 including a valance assembly attached to the main tub section and held in a position adjacent to the tambour slats of the tambour door when the tambour door is in a closed position in which the tambour door is between the seal and the valance.

29. A bath tub having side access as set forth in claim 28 wherein the valance assembly is attached to the main tub section by one or more latches that are releasable to allow the valance assembly to move away from the main tub section for cleaning and maintenance.

30. A bath tub having side access as set forth in claim 1 including a sanitary drip pan mounted to the main tub section under the bottom wall for catching any water which drips from the tambour door.

31. A bath tub having side access to facilitate ingress and egress including a main tub section with a fixed side wall, a pair of fixed end walls integral with the fixed side wall, a bottom wall integral with the fixed side wall and the pair of fixed end walls, a drain in the bottom of the main tub section and an open side having a sealing surface, said open side being integral with said end walls and said bottom wall, and located opposite the fixed side wall; a track assembly with generally vertical guides supported on the open side of the main tub section and generally horizontal guides supported below the bottom wall of the main tub section; a tambour door assembly having a plurality of parallel tambour slats faced by a flexible water impervious membrane that substantially covers one side of the tambour slats and that is guided by the track assembly for movement between a position generally below the bottom wall in which the open side of the tub is open and a raised position adjacent to the open side of the main tub section in which the open side of the tub is closed; and a seal for sealing between the main tub section and the tambour door including an inflatable elongated tube attached to the sealing surface on the open side of the main tub section and positioned between the tambour door and the main tub section when the open side of the main tub section is closed; said seal including a lip seal that extends beyond the inflatable elongated tube laterally along said tambour door to be in direct contact with water in the bath tub when the bath tub is full of water so that the water holds the lip seal in sealing contact with said flexible water impervious membrane.

32. A bath tub having side access as set forth in claim 31 including a pump connected to the inflatable elongated tube and operable to inflate the tube to seal between the door and the main tub section.

33. A bath tub having side access to facilitate ingress and egress including a main tub section with an open side; a door supported by the main tub section for closing the open side of the main tub section; a seal for sealing between the main tub section and the door; and an electrical control system for controlling operation of the bath tub including a solenoid operated door lock, a drain closure, and a water level sensor that provides an electric output signal, and wherein the system is operative such that said drain closure remains open until the solenoid operated door lock locks the door in a closed position and the solenoid operated door lock remains locked until the water level sensor senses that the water level in the tub is below a predetermined level.

34. A bath tub having side access as set forth in claim 33 wherein the seal for sealing between the main tub section and the door includes an inflatable tube, the control system includes a fluid pump connected to the inflatable tube and wherein the drain closure remains open until the door is locked in a closed position and the inflatable tube is inflated and wherein the solenoid operated door lock remains locked until the water level sensor senses that the water level in the tub is below a predetermined level and the inflatable tube is deflated.

35. A method for controlling a bath tub having side access for ingress and egress including a main tub section with a fixed side wall, a pair of fixed end walls, a bottom wall, a drain in the bottom of the main tub section, an open side, a door assembly mounted by the tub main section, including a door operable to close and open the open side, a control system operable to receive a bathe signal and a drain signal and including a door switch, a door lock, and a water level sensor, and a seal positioned between the door and the main tub section including:

sending a bathe signal to said control system;
activating a door switch to indicate that the door is in a closed position;
locking the door in said closed position in response to closing the door;
closing the drain after the door is locked in said closed position;
sending a drain signal to the control system;
sensing the water level in the tub;
opening the drain in response to the drain signal; and
unlocking the door after the water level in the tub drops to a predetermined level.

36. A method for controlling a bath tub as set forth in claim 35 wherein the seal includes an inflatable tube, the mechanism for inflating and deflating said tube is connected in said control system and which method further includes:

inflating the inflatable tube after the door is locked in a closed position;
closing the drain after the seal is inflated;
deflating the seal after the control system receives a drain signal and senses that the water level in the tub has fallen below a predetermined level; and
unlocking the door after pressure in the inflated seal drops below a predetermined pressure.

37. A method for controlling a bath tub having side access for ingress and egress including a main tub section with a fixed side wall, a pair of fixed end walls, a bottom wall, a drain in the bottom of the main tub section, an open side, a door assembly operable to close and open the open side, a seal including an inflatable tube positioned between the door and the main tub section when the open side is closed by the door, a mechanism for inflating said tube and a control system operable to receive bathe and drain signals and including a sensor for sensing the door is closed, the steps of:

sending a bathe signal to the control system;
sensing that the door is in a closed position;
inflating the seal in response to a bathe signal and a signal that the door is in a closed position;

closing the drain in response to a bathe signal after the door is in a closed position and in response to seal inflation;

sending a drain signal to the control system; and opening the drain.

38. The method for controlling a bath tub as set forth in claim 37 wherein the control system includes a water level sensor, the further steps of:

sensing the water level in the tub;

sending a drain signal to the control system;

opening the drain in response to the drain signal;

deflating the seal after the drain is opened and the water level has dropped to a predetermined level; and opening the door after the drain is opened and the seal is deflated.

39. A bath tub having a main tub section with a fixed side wall, two fixed end walls integral with the fixed side wall, a bottom wall integral with the fixed side wall and the two fixed end walls and an open side for ingress and egress, said open side having a sealing surface opposite the fixed side wall that is integral with the fixed end walls and the bottom wall, a track at each end of the main tub section attached to the main tub section adjacent to the open side, a door having an interior and exterior surface and side edges guided by the track, and operable in one position to close the open side of the main tube section and in another position to leave it open, an inflatable seal between the main tub section and the door and in contact with said sealing surface and the interior surface of the door when the door is in said one position, and a valance holdable in fixed position relative to the main tub section adjacent to the open side of the main tub section where it overlies at least part of the tracks and the sides of the door when the door is closing said open side of the main tub section and wherein the valance is in position to be contacted by the door to restrain movement of the door horizontally away from the main tub section when the bath tub is filled with water.

40. A bath tub as set forth in claim 39 wherein the seal includes an inflatable tube.

41. A bath tub as set forth in claim 39 wherein the door is a tambour door that includes a plurality of tambour slats and the interior surface of the door is provided by a flexible impervious membrane attached to at least some of the tambour slats.

42. A bath tub having a main tub section with a fixed side wall, two fixed end walls integral with the fixed side wall, a bottom wall integral with the fixed side wall and the two fixed end walls and an open side for ingress and egress; a track supported by the main tub section at each end of the main tub section, each track having a generally vertical portion adjacent to the open side of the main tub section and a generally horizontal portion below the bottom wall of the main tub section; a door guided by the track between a position in which the door closes the open side of the main tub section and a storage position in which the side of the main tub section is open for ingress and egress and wherein the door is positioned in the generally horizontal portion of the tracks and below the bottom wall of the tub; and a spring system, for counterbalancing gravitational forces that tend to move the door along the tracks, including a first take-up spool supported by the main tub section for rotation about a first axis, a first steel ribbon linear force spring with one end attached to the first take-up spool and the other end attached to the door, a second take-up spool supported by the main tub section for rotation about a second axis that is parallel to said first axis, and a second steel ribbon linear force spring with one end attached to the second take-up spool and the other end attached to the door.

43. A bath tub as set forth in claim 42 wherein the first and second steel ribbon linear force springs are attached to the door through a cam and sprocket assembly that reduces a force exerted on the door as the door moves from the vertical portions of the tracks to the horizontal portions of the tracks.

44. A bath tub as set forth in claim 43 wherein the door is a tambour door with a plurality of tambour slats and a flexible impervious membrane secured to at least some of the tambour slats.

45. A bath tub having side access to facilitate ingress and egress including a main tub section with a fixed side wall, a pair of fixed end walls integral with the fixed side wall, a bottom wall integral with the fixed side wall and the fixed end wall, and an open side, with a sealing surface, that is integral with the end walls and the bottom wall; a door operable to close the open side; and a seal for sealing between the main tub section and the door including an inflatable elongated tube positioned between the door and the sealing surface on the open side of the main tub section, the inflatable elongated tube comprising a base in contact with said sealing surface on the main tub section, a side wall section that extends from the base and has an outer seal surface for engaging said doors, and a flexible bellows wall section connecting the base and side wall section which is operable to collapse under the pressure of water should the seal be deflated and allow the pressure of water in the tub to hold the seal surface in contact with the door.

46. A bath tub having side access to facilitate ingress and egress including a main tub section with an open side; a door that is movable between an open position for ingress and egress and a closed position in which the open side of the main tub section is closed; a seal for sealing between the main tub section and the door including an inflatable tube; and a control system for controlling operation of the bath tub including a power source, a fluid pump connected to the inflatable tube, a water level sensor a drain closure, a control panel operable to activate the control system in a bathe mode and a drain mode, and wherein the control system when in a bathe mode connects the fluid pump to the power source to inflate the inflatable tube and closes the drain closure only after the inflatable tube is inflated.

47. A bath tub having side access as set forth in claim 46 wherein the control system insures that the drain closure is closed only when the inflatable tube is inflated, and further insures that the inflatable tube in the door seal remains inflated when the water level sensor senses that the water level in the tub is above a predetermined level at times when the control system is in a bathe mode and when the control system is in a drain mode.

48. A bath tub having side access to facilitate ingress and egress including a main tub section with an open side; a door that is movable between an open position for ingress and egress and a closed position in which the open side of the main tub section is closed; an inflatable seal for sealing between the main tub section and the door; a drain which holds water in the tub when it is closed and allows water to drain from the tub when it is open; and a control system for controlling operation of the drain and seal that includes a control panel operable to activate the control system in a bathe mode and a drain mode, and a fluid pump in the control system connected to the inflatable seal to inflate it the control system closing the drain only after the inflatable seal is inflated when the control system activates the fluid pump to inflate the seal and prepare the bath tub for bathing.

49. A bath tub having side access as set forth in claim 48 wherein the control system includes a water level sensor and the control system deflates the inflatable seal only when the water level sensor senses that the water level in the tub is below a predetermined level.

50. A bathing enclosure having side access to facilitate ingress and egress including a main enclosure section with a fixed side wall, a pair of fixed end walls integral with the side wall, a bottom wall integral with the side and end walls, a drain valve in the bottom of the tub main section and an open side integral with said fixed end walls and said bottom wall and having a marginal sealing surface on the side of the main enclosure section opposite the fixed side wall; a tambour door with a plurality of parallel tambour slats and a flexible water impervious membrane attached to one side of the tambour slats; valance for the tambour door supported by the main enclosure section; a track assembly supported by the main enclosure section to guide the tambour door in its movement relative to the sealing surface on the main enclosure section to a position in which the open side of the main enclosure is closed by the said door and to guide the tambour door relative to the sealing surface on the main enclosure section to a position in which the main enclosure is open; a seal in sealing contact with the sealing surface on the main enclosure section and having a tambour door contact surface in contact with the flexible impervious membrane on the tambour slats when the tambour door is closing the open side of the main enclosure section; and an activator to apply a force to the seal to seal the sealing surface on the main enclosure section and the flexible impervious membrane and prevent leakage when the tambour door closes the open side of the main enclosure section.

51. A bathing enclosure as set forth in claim 50 wherein the activator for applying a force to the seal includes an inflatable tubular passage in the seal which, when inflated, compresses the flexible impervious membrane between the seal and the tambour slats.

52. A bathing enclosure as set forth in claim 50 wherein the activator for applying a force to the seal compresses the tambour door between the valance and the seal.

53. A bathing enclosure as set forth in claim 50 wherein the force between the seal and the flexible impervious membrane holds the tambour door in the closed position when the activator for applying force to the seal is activated.

54. A bathing enclosure as set forth in claim 53 wherein deactivation of the activator for applying force to the seal reduces the forces between the seal and the flexible impervious membrane thereby allowing the tambour door to be opened.

55. A bathing enclosure as set forth in claim 50 wherein deactivation of the activator for applying force on the seal allows the tambour door to move out of contact with the valance.

56. A bathing enclosure as set forth in claim 50 wherein the track assembly to guide the tambour door guides the tambour door to a position under the bottom wall of the main enclosure section to open the main enclosure.

57. A bathing enclosure as set forth in claim 50 including a drip pan under the bottom wall to catch drips.

58. A bathing enclosure as set forth in claim 50 including rollers attached to at least some of the tambour slats and in engagement with the track assembly to guide the tambour door.

59. A bathing enclosure as set forth in claim 50 including a counterbalance system for counterbalancing the weight of the tambour door.

60. A bathing enclosure as set forth in claim 50 including a shaft rotatably supported adjacent to the track assembly, and a pair of sprockets mounted on the shaft and in engagement with the tambour door to keep the tambour door in alignment with the track assembly.

61. A bath tub having side access to facilitate ingress and egress including a main tub section with a fixed side wall, a pair of fixed end walls integral with the fixed side wall, a bottom wall integral with the fixed side wall and the pair of fixed end walls, a drain for the bottom of said main tub section and an open side having a sealing surface, said open side being integral with said end walls and said bottom wall, and located opposite said fixed side wall; a tambour door assembly including a tambour door, and a track assembly for guiding the door between a first position and a second position, said door having a plurality of parallel tambour slats faced by a flexible impervious membrane substantially covering one side of the parallel tambour slats, and being guided by the track assembly in movement between the first position in which the open side of the tub is open and the door is located generally under the bottom wall and the second position adjacent to the open side of the main tub section in which the open side of the tub is closed; and a seal, in contact with said sealing surface on the main tub section and in contact with the flexible impervious membrane of the tambour door when the tambour door is in said second position for preventing water loss.

* * * * *

UNITED STATES PATENT AND TRADEMARK OFFICE

CERTIFICATE OF CORRECTION

PATENT NO. : 5,351,345

DATED : October 4, 1994

INVENTOR(S) : Arthur A. Sills, Frederick A. Kilbourn, Brian K. Nelson, and Donald J. Henderson It is certified that error appears in the above-indentified patent and that said Letters Patent is hereby corrected as shown below:

Column 17, line 28, change "tube" to -- tub --.

Column 18, line 20, change "wall" to -- walls --; line 30, change "doors" to -- door --; line 45, after "sensor" insert a comma.

Signed and Sealed this

Twentieth Day of December, 1994

*Attest:*

Bruce Lehman

BRUCE LEHMAN

*Attesting Officer*

*Commissioner of Patents and Trademarks*